US005343185A

United States Patent [19]

Mosesian et al.

[11] Patent Number: 5,343,185

[45] Date of Patent: Aug. 30, 1994

[54] TIME DELAY FUSE WITH MECHANICAL OVERLOAD DEVICE

[75] Inventors: Jerry L. Mosesian, Newburyport, Mass.; Clyde D. Reid, South Hampton, N.H.

[73] Assignee: Gould Electronics Inc., Eastlake, Ohio

[21] Appl. No.: 94,609

[22] Filed: Jul. 19, 1993

[51] Int. Cl.[5] ..... H01H 85/04

[52] U.S. Cl. ..... 337/163; 337/165

[58] Field of Search ..... 337/163, 164, 165, 166

[56] References Cited

U.S. PATENT DOCUMENTS 2,300,620 11/1942 Duerkob ..... 337/164
2,321,711 6/1943 Taylor .
3,020,372 2/1962 Kozacka .
3,061,700 10/1962 Fister .
3,122,619 2/1964 Fister .
3,240,905 3/1966 Kozacka .
3,342,964 9/1967 Kozacka .
3,483,501 12/1969 Kozacka .
3,721,935 3/1973 Kozacka .
4,041,435 8/1977 Gaia .
4,053,860 10/1977 Kozacka et al. .
4,058,786 11/1977 Gaia et al. .
4,134,094 1/1979 Huber .
4,184,137 1/1980 Gaia et al. .
4,344,058 8/1982 Knapp, Jr. et al. .
4,369,422 1/1983 Rasmussen et al. .
4,375,630 3/1983 Gaia .
4,417,224 11/1983 Ross .
4,533,895 8/1985 Kowalik et al. .
4,727,347 2/1988 Cambio et al. .
4,992,770 12/1991 Spaulding et al. .
4,994,779 2/1991 Douglass .
5,075,664 12/1991 Spalding et al. .
5,077,534 12/1991 Douglass ..... 337/164

*Primary Examiner*—Lincoln Donovan
*Attorney, Agent, or Firm*—Fish & Richardson

[57] ABSTRACT

A fuse including a tubular casing, first and second blade-shaped terminals extending from respective sides of the casing, a short circuit fusible element attached to the first terminal, a heater attached to the second terminal, and a time delay overcurrent trigger mechanism electrically connecting the fusible element and the heater to each other in series in an electrical path between the blade-shaped terminals, the mechanism being connected to receive heat from the heater and to mechanically interrupt the electrical path when the heater heats up under low overcurrent conditions.

18 Claims, 2 Drawing Sheets

TIME DELAY FUSE WITH MECHANICAL OVERLOAD DEVICE

Background of the Invention

The invention relates to fuse subassemblies and fuses made therefrom having time delay features.

Time delay fuses often have a fusible element (e.g., a wire or thin metal strip with notch sections) that quickly melts at short circuit conditions (e.g., 20 times the rated current) and another means to break the circuit slowly (e.g., solder that retains a spring-loaded member and melts after the solder has been raised to a specific temperature) at lower overloads (e.g., 2 to 5 times rated current) to permit use with equipment having temporary surges such as motors. U.S. Pat. No. 4,344,058 describes a time delay fuse having a fusible element, a spring-loaded member, and a strip metal heater located adjacent to the spring-loaded member in order to provide controlled heating and release of the spring-loaded member.

Another way to achieve time delay is through the use of a so-called M-effect element, which involves a mass of metal on a fusible element to provide timed delay melting at low overload conditions.

Depending upon the requirements for use, fuses can have end terminals (for making electrical connection) made of end cap members, threaded connections, blade-shaped terminals, or other configurations. When blade-shaped terminals are used, they can terminate at a metal end block that closes an end of a fuse casing or can pass through an end wall at the end of the fuse casing. For example, the UL RK5 100 class time delay fuse employs blade-shaped terminals.

SUMMARY OF THE INVENTION

The invention features, in general, a fuse that includes a pair of blade-shaped terminals, a short circuit fusible element, a heater, and a time delay overcurrent trigger mechanism. The fusible element is directly attached to one blade-shaped terminal, and the heater is directly attached to the other terminal. The time delay overcurrent trigger mechanism connects the fusible element and the heater in series in an electrical path between the terminals. The trigger mechanism is connected to receive heat from the heater and to mechanically interrupt the electrical path when the heater generates heat under low overcurrent conditions.

In preferred embodiments, the heater is made of a strip of sheet metal. The time delay overcurrent trigger mechanism includes a spring-biased plunger with an end that is connected to the fusible element by a first mass of solder and to the heater at another location on the plunger by a second mass of solder. The heater goes along two sides of the spring-biased plunger and connects to the blade-shaped terminal on two sides. The heater and fusible element are connected to the terminals by spot welding. The blade-shaped terminals pass through slots in end caps on the fuse housing. A pin through a hole in the terminals retains the blade-shaped terminal within the housing. The fusible element has a U-shaped cross section.

Two spring-loaded trigger mechanisms and associated heaters can be connected in parallel, one on each side of the blade-shaped terminal. Similarly, two fusible elements can be connected in parallel, one on each side of the blade-shaped terminal. When two trigger mechanisms are used, there would also be at least one fusible element associated with each connected to a respective side of the blade-shaped terminal. Two or more fusible elements can be used with a single trigger mechanism, and there can be two or more trigger mechanisms lined up on the same side of the fusible element. In an arrangement with more than one trigger mechanism, one could be connected to one terminal, and one could be connected to the other.

Other advantages and features of the invention will be apparent from the following description of preferred embodiments thereof and from the claims.

DESCRIPTION OF THE PREFERRED EMBODIMENTS

The drawings will be described first.

DRAWINGS

STRUCTURE

Figure 1:
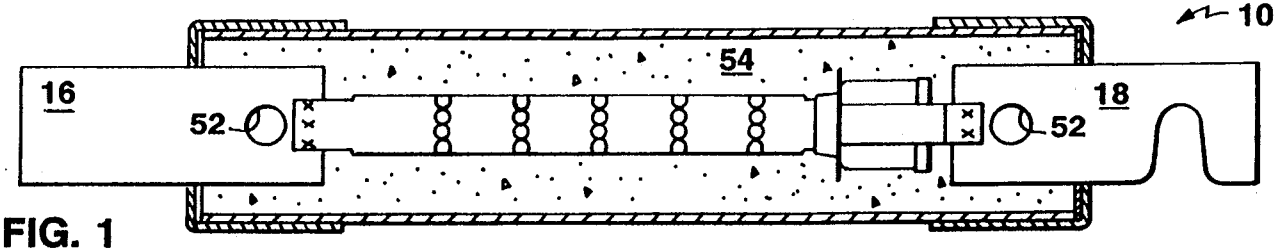
FIG. 1 is a sectional view of a time delay fuse according to the invention.
Figure 2:
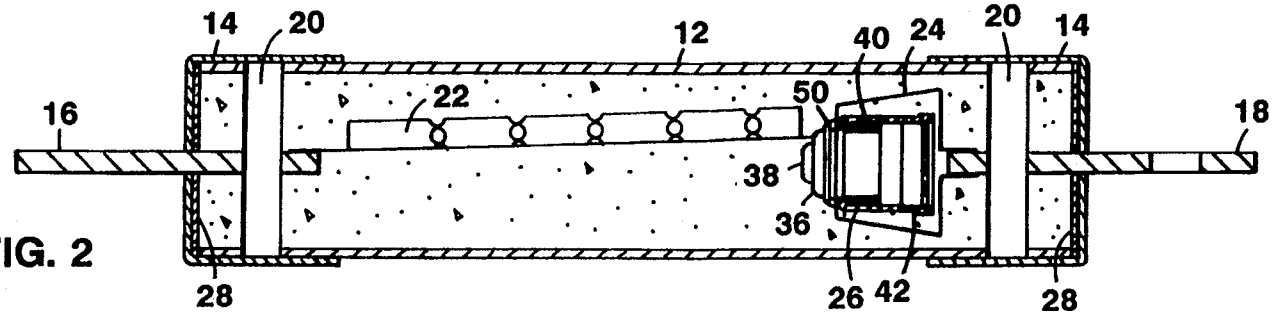
FIG. 2 is a sectional view, taken at an orientation rotated 90° with respect to the section of FIG. 1, of the FIG. 1 time delay fuse.
Figure 5:
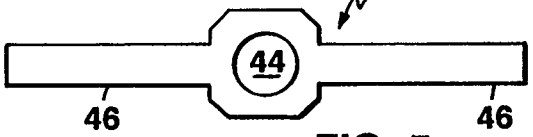
FIG. 5 is a plan view of a strip metal heater used in the FIG. 1 fuse before forming.

Referring to FIGS. 1 and 2, there is shown time delay fuse 10 including insulative fuse casing 12, metal end caps 14, blade-shaped terminals 16, 18, pins 20, fusible element 22, heater 24, trigger mechanism 26, and insulative washer 28. Pins 20 pass through respective holes 52 in blade-shaped terminals 16, 18 and holes in tubular housing 12. Blade-shaped terminals 16, 18 pass through slots in end caps 14 and washers 28. Inside fuse casing 12 is arc quenching fill material 54.

Figure 4:
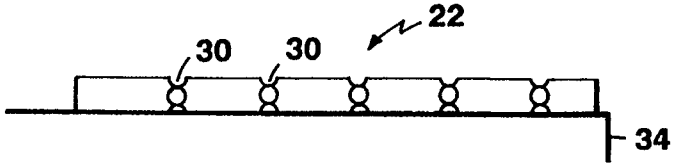
FIG. 4 is an elevation of the FIG. 3 fusible element after forming.

Referring to FIGS. 1–4, fusible element 22 includes a plurality of notch sections 30 provided by rows of holes. Fusible element 22 includes tab 32, which is spot welded to a surface at the end of terminal 16, as indicated by X's on FIG. 1. It also includes a tab 34 that is bent (as shown in FIG. 4) and is soldered to plunger 36 of trigger mechanism 24 at first solder mass 38. Fusible element 22 has a U-shaped cross section with side portions that extend beyond the widths of tabs 32, 34 sticking up in the air.

Figure 6:
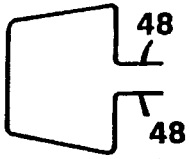
FIG. 6 is an elevation of the FIG. 5 heater after forming.
Figure 3:
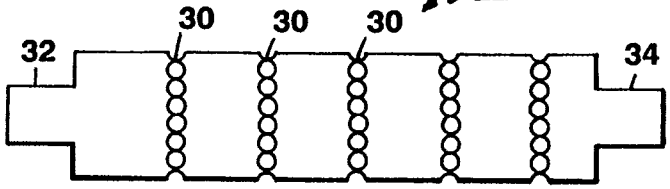
FIG. 3 is a plan view of a fusible element of the FIG. 1 fuse before forming.

Referring to FIGS. 1, 2, 5 and 6, trigger mechanism 26 includes plunger 36, spring 40, and housing 42. Heater 24 has circular opening 44 that receives the end of plunger 36. Legs 46 of heater 24 are bent as indicated in FIG. 6 and extend around housing 42 and provide two ends 48 that are spot welded to blade-shaped terminal 18 as indicated by the X's on FIG. 1. Strip metal heater 24 is connected to plunger 36 by second solder mass 50, which additionally retains plunger 36 in the compressed spring-biased condition shown in FIG. 2.

MANUFACTURE

In manufacture, a subassembly including blade-shaped terminal 16, fusible element 12, heater 24, trigger mechanism 26, blade-shaped terminal 18, and solder masses 38, 50 is first prepared. The subassembly is then placed within housing 12, and pins 20 are inserted through the holes in the housing and holes 52 to retain the subassembly in position. One end cap 14 and associated washer 28 are then attached; arc quenching fill is introduced; and then the other end cap and washer 28 are attached.

In addition to being spot-welded, the fusible element and heater could be soldered to the blades or even riveted to the blade-shaped terminals. By directly attaching the fusible element and strip metal heater to the blade-shaped terminals, the use of end bells is avoided, with saving in cost.

OPERATION

In operation, fusible element 22 melts quickly at short circuit conditions. At low overload conditions, the temperature of strip metal heater 24 rises, and this heats the mass provided by solder mass 50, plunger 36, solder mass 38, and housing 42. When solder masses 38, 50 reach their melting temperatures, plunger 36 is released and biased to the right by spring 40, breaking the circuit. The use of a strip metal heater provides accurate control of heat generation under overload current conditions.

OTHER EMBODIMENTS

Other embodiments of the invention are within the scope of the following claims. For example, as shown in FIGS. 7, 8, 9, and 10 there can be more than one trigger mechanism and/or more than one fusible element directly attached to blade-shaped terminals.

Figure 7:
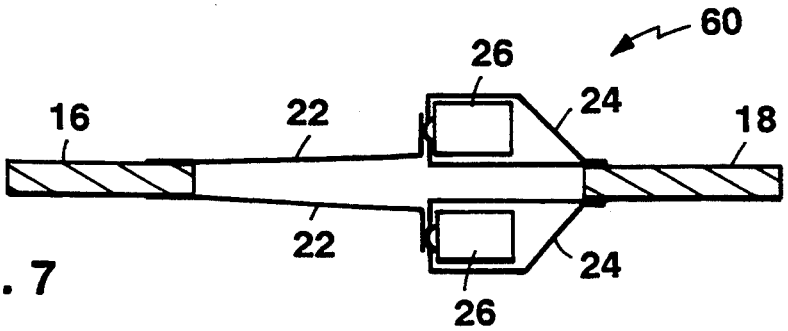
FIGS. 7, 8 and 9 are sectional views of subassemblies of alternative embodiments of fuses according to the invention.

In FIG. 7, fuse assembly 60 includes two trigger mechanisms 26 and associated heaters 24 with respective fusible elements 22.

Figure 8:
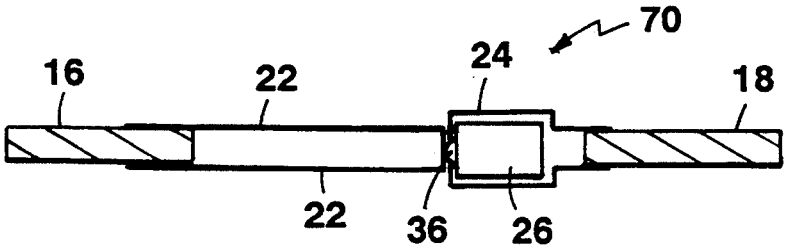

In FIG. 8, fuse assembly 70 uses a single trigger mechanism 26 and associated strip metal heater 24 with two fusible elements 22, which are attached to respective sides of terminal 16.

Figure 9:
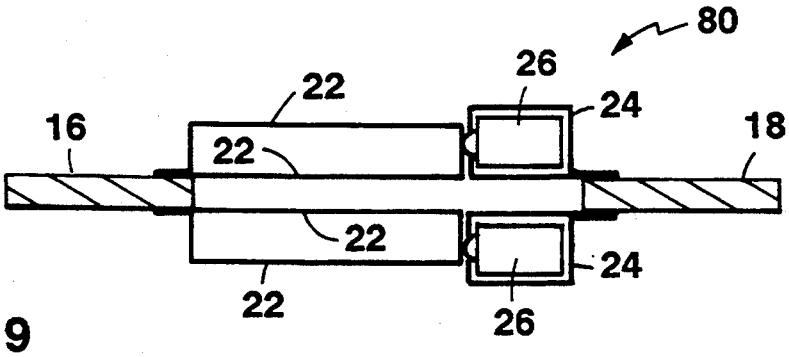

In FIG. 9, fuse assembly 80 includes two trigger mechanisms 26 and associated heaters 24. The plunger of each trigger mechanism is connected to a pair of fusible elements 22. The ends of fusible elements 22 are joined together at blade-shaped terminal 16.

In the embodiments of FIGS. 7 and 9, where there are two heaters 24, the two ends of each heater are connected to a respective side of blade-shaped terminal 18. In both the FIG. 7 embodiment and the FIG. 9 embodiment, one trigger mechanism could be connected to terminal 18, and the other could be connected to terminal 16.

In the embodiments of FIGS. 8 and 9, fusible elements 22 could be two segments of a common piece of metal joined by solder to plunger 36 or they could be two separate pieces of metal.

Figure 10:
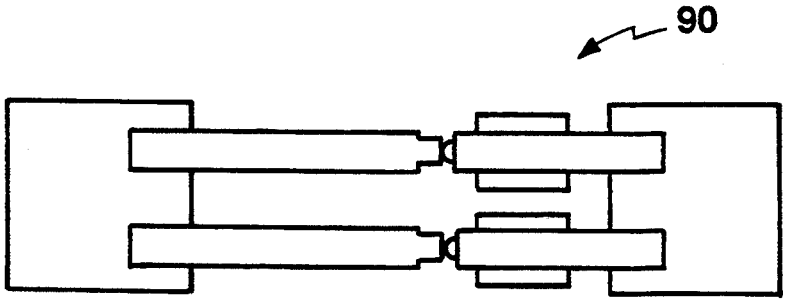
FIG. 10 is a plan view of another alternative embodiment of a fuse according to the invention.

If desired, there could be a plurality of fusible elements and heaters connected to the same side of a blade-shaped terminal across its width, as is shown for assembly 90 in FIG. 10, and there could be a plurality on one side and a plurality on the other side.

What is claimed is:

1. A fuse subassembly comprising first and second blade-shaped terminals having flat faces, a short circuit fusible element attached to said first terminal, a heater attached to said second terminal, and a time delay overcurrent trigger mechanism electrically connecting said fusible element and said heater to each other in series in an electrical path between said blade-shaped terminals, said mechanism being connected to receive heat from said heater and to mechanically interrupt said electrical path when said heater heats up under low overcurrent conditions, said trigger mechanism comprising a housing having a front, sides and a back, a spring in said housing, and a plunger that is biased by said spring and secured in a triggered position by a mass of solder, said plunger having an end extending from said front of said housing, said heater comprising a strip of sheet metal that has a first section with an opening through which said end of said plunger extends, second and third sections that are bent with respect to said first section and extend along said sides of said housing, a fourth section that is connected to said second section and bent with respect to it and extends along said back of said housing, a fifth section that is bent with respect to said fourth section and is parallel to a flat face of said terminal, and a sixth section that is connected to said third section and is parallel to said fifth section, said fifth and sixth sections being attached to said second terminal.

2. The subassembly of claim 1 wherein said fusible element is connected to said plunger by a first solder mass, and said heat is connected to said plunger by a second solder mass, said second solder mass being the same solder mass that retains said plunger with respect to said housing.

3. The subassembly of claim 1 wherein said fifth and sixth sections are attached to said flat faces on both sides of said second blade-shaped terminal.

4. The subassembly of claim 1 wherein said heat is spot welded to said second blade-shaped terminal.

5. The subassembly of claim 1 wherein said fusible element is spot welded to said first blade-shaped terminal.

6. The subassembly of claim 1 further comprising a second fusible element attached to said first blade-shaped terminal, a second heater attached to said second blade-shaped terminal, and a second trigger mechanism electrically connecting said second fusible element and said second heater to each other in series in a second electrical path between said blade-shaped terminals, said second mechanism being connected to receive heat from said heater and to mechanically interrupt said second electrical path when said heater heats up under low overcurrent conditions.

7. The subassembly of claim 1 wherein there are two said fusible elements attached to said first blade-shaped terminal and connected to said trigger mechanism.

8. The subassembly of claim 6 wherein there are two said fusible elements attached to said first blade-shaped contact and connected to each said trigger mechanism.

9. The subassembly of claim 7 wherein each said fusible element is made of a single piece of metal that is connected at a midsection to said trigger mechanism and folded over to have two parallel portions.

10. A fuse comprising a tubular fuse casing, first and second blade-shaped terminals extending from respective sides of said casing and having flat faces, a short circuit fusible element attached to said first terminal, a heater attached to said second terminal, and a time delay overcurrent trigger mechanism electrically connectings aid fusible element and said heater to each other in series in an electrical path between said blade-shaped terminals, said mechanism being connected to receive heat from said heater and to mechanically interrupt said electrical path when said heater heats up under low overcurrent conditions, said trigger mechanism comprising a housing having a front, sides and a back, a spring in said housing, and a plunger that is biased by said spring and secured in a triggered position by a mass of solder, said plunger having an end extending from said front of said housing.

said heater comprising a strip of sheet metal that has a first section with an opening through which said end of said plunger extends, second and third sections that are bent with respect to said first section and extend along said sides of said housing, a fourth section that is connected to said second section and bent with respect to it and extends along said back of said housing, a fifth section that is bent with respect to said fourth section and is parallel to a flat face of said terminal, and a sixth section that is connected to said third section and is parallel to said fifth section, said fifth and sixth sections being attached to said second terminal.

11. The fuse of claim 10 wherein said fusible element is connected to said plunger by a first solder mass, and said heater is connected to said plunger by a second solder mass, said second solder mass being the same solder mass that retains said plunger with respect to said housing.

12. The fuse of claim 10 wherein said fifth and sixth sections are attached to said flat faces on both sides of said second blade-shaped terminal.

13. The fuse of claim 10 wherein said heater is spot welded to said second blade-shaped terminal.

14. The fuse of claim 10 wherein said fusible element is spot welded to said first blade-shaped terminal.

15. The fuse of claim 10 further comprising a second fusible element attached to said first blade-shaped terminal, a second heater attached to said second blade-shaped terminal, and a second trigger mechanism electrically connecting said second fusible element and said second heater to each other in series in a second electrical path between said blade-shaped terminals, said second mechanism being connected to receive heat from said second heater and to mechanically interrupt said second electrical path when said second heater heats up under low overcurrent conditions.

16. The fuse of claim 10 wherein there are two said fusible elements attached to said first blade-shaped terminal and connected to said trigger mechanism.

17. The fuse of claim 15 wherein there are two said fusible elements attached to said first blade-shaped contact and connected to each said trigger mechanism.

18. The fuse of claim 16 wherein each said fusible elements is made of a single piece of metal that is connected at a midsection to said trigger mechanism and folded over to have two parallel portions.

* * * * *